US006494295B2

(12) United States Patent
Grundmann

(10) Patent No.: US 6,494,295 B2
(45) Date of Patent: Dec. 17, 2002

(54) METHOD AND APPARATUS FOR COMPENSATING VIBRATIONS IN ELEVATOR CARS

(75) Inventor: Steffen Grundmann, Bonstetten (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/977,457

(22) Filed: Oct. 15, 2001

(65) Prior Publication Data

US 2002/0046906 A1 Apr. 25, 2002

(30) Foreign Application Priority Data

Oct. 23, 2000 (EP) ..... 00810979

(51) Int. Cl.[7] ..... B66B 1/34
(52) U.S. Cl. ..... 187/292; 187/393
(58) Field of Search ..... 187/292, 393, 187/394, 409, 410, 945, 346; 318/611, 623

(56) References Cited

U.S. PATENT DOCUMENTS 5,308,938 A 5/1994 Roberts et al.
5,368,132 A * 11/1994 Hollowell et al. ..... 187/393
5,544,721 A 8/1996 Roberts
5,597,988 A 1/1997 Skalski
5,811,743 A 9/1998 Kohara et al.
5,866,861 A * 2/1999 Rajamani et al. ..... 187/292
5,896,949 A * 4/1999 Hamdy et al. ..... 187/292
6,216,824 B1 * 4/2001 Fuller et al. ..... 187/292

FOREIGN PATENT DOCUMENTS

JP 03088690 A * 4/1991 ..... B66B/11/02
JP 4-191265 A * 4/1992
JP 05092886 A * 4/1993 ..... B66B/11/02
JP 05319739 12/1993

* cited by examiner

*Primary Examiner*—Jonathan Salata
(74) *Attorney, Agent, or Firm*—MacMillan, Sobanski & Todd, LLC

(57) ABSTRACT

A method and system for compensating vibrations in an elevator car, which elevator car is guided on at least one guide rail, the vibrations being detected by at least one sensor at a source of disturbance by at least another sensor at an affected point on the elevator car. Both detected vibrations are interpreted by a control to drive a compensating mass on the elevator car to neutralize the vibrations at the affected point by a compensating force of opposite sign and equal amount.

16 Claims, 4 Drawing Sheets

METHOD AND APPARATUS FOR COMPENSATING VIBRATIONS IN ELEVATOR CARS

BACKGROUND OF THE INVENTION

The present invention relates to the transportation of persons in elevator cars and, in particular, to a method and a system for compensating vibrations in elevator cars.

Systems for the transportation of persons often comprise an elevator car that is guided by guide shoes along guide rails. With this type of guidance, vibrations occur which have their origin in the shape and fastening of the guide rails, and/or in pressure variations in the airstream of the elevator car. Such vibrations transferred to the elevator car, especially at high transportation speeds, are unpleasant experiences for the passengers. It is also possible for resonances to occur if the frequency of vibration takes on high values when approaching the resonant frequency of the elevator car.

The U.S. Pat. No. 5,811,743 shows a controlling means for elevator cars in which vibrations are continuously detected by sensors and then compensated by suitable means in a feedback control system. Such compensation of vibrations takes place either by movement of the elevator car relative to the guide shoes, or else by movement of a compensating mass relative to the elevator car. In the latter embodiment, the coupling of the elevator car to the guide shoes is not rigid, but elastic, so that during travel of the elevator car there is a delay in the transfer of vibrations from the guide shoes to the elevator car, and the controlling means has sufficient time to move the compensating mass. By this means vibrations are reduced, but they are not completely eliminated.

The objective of the present invention is therefore to obtain such highly effective compensation of vibrations in systems for transporting persons, that the vibrations are not noticed by the passengers. In particular, vibrations of low frequency are to be compensated, which are known as nuisance vibrations and experienced as particularly annoying by passengers. The apparatus according to the present invention shall be compatible with common technologies and methods of the freight and passenger transportation industry. Furthermore, it should be possible by simple manner and means to retrofit existing passenger transportation systems with the invention.

SUMMARY OF THE INVENTION

The present invention is based upon abandonment of the method of compensation of vibrations on elevator cars utilized in the prior art. The basic idea of the present invention consists of detecting vibrations, and especially nuisance vibrations, as early as possible so as to compensate them optimally. This is done by multiple detection of the vibration pattern over time. The vibrations are not only detected at the place where they are experienced as annoying, i.e. on the elevator car, but are also detected where they are generated, i.e. at a source of disturbance.

Thus, the pattern over time of disturbing values of acceleration of the elevator car is detected by at least one acceleration sensor on the elevator car, and the pattern over time of disturbing values of acceleration and/or pressure values is detected by at least one further acceleration and/or pressure sensor at the source of disturbance. Disturbing values of acceleration are caused by, for example, deviations from the perpendicular, and/or ideal line, of a guide shoe along guide rails. Disturbing pressure values are, for example, pressure variations in the airstream of the elevator car. It is advantageous for the acceleration sensor to be attached to a guide shoe, and the pressure sensor attached to the elevator car.

The acceleration values of the elevator car are applied as feedback values, and the acceleration and/or pressure values are applied as disturbance variables to the input of a controlling means. This makes available on the input of the controlling means the pattern over time of disturbance variables and the pattern over time of feedback values, i.e. the effect of the disturbance on the elevator car. The pattern over time of the feedback values, and that of the disturbance variables, is detected as a time function, preferably at regular time intervals. Within this detection accuracy, the time of occurrence of a disturbing force, and its development over time, are detected both at the source of disturbance and on the elevator car.

The relationship between these time functions is described by a transfer function. Disturbance variables and feedback values are interpreted in the controlling means according to the transfer function. The transfer function is based on mechanical parameters of the passenger transportation system, such as the unladen weight of the elevator car, the hardness of the springing/damping elements, the momentary position and the weight of a compensating mass, the momentary load being transported, the momentary distribution of the load in the elevator car, etc. At least one of these mechanical parameters is known, or else its latest value is determined at preferably regular time intervals so its latest value is known. Certain mechanical parameters such as the unladen weight of the elevator car, the weight of the compensating mass, the hardness of the springing/damping elements, can be determined once before the passenger transportation system is put into operation. Other mechanical parameters, such as the position of the compensating mass, the load being transported, and the distribution of the load in the elevator car, can be determined with their latest values.

In the controlling means, disturbance variables are used for feedforward control, and feedback values for feedback control. The transfer function thus allows systematic activation of at least one compensating mass taking into account the known, or latest known, mechanical parameters of the passenger transportation system. Systematic activation of the compensating mass is understood as a driving of the linearly or rotationally moved compensating mass fastened to the elevator car, with the objective of counteracting the disturbing force which has arisen with a compensating force such that the disturbing force is largely neutralized. The disturbing force is neutralized by a compensating force of opposite sign and preferably equal amount. The compensating force need not necessarily be equal in amount to the disturbing force, but it should be at least so large that the vibrations caused by the uncompensated parts of the disturbing force are not perceived by passengers. On the elevator car, the disturbing force as it develops over time is counteracted by a compensating force which develops over time. The compensating mass is moved by at least one drive. The drive is controlled by the controlling means by means of correcting variables.

As well as the compensation of disturbance variables as described, the acceleration of the elevator car is also controlled by feedback. A controlling function for this purpose is provided in the controlling means. For the reference value of acceleration it is given the value zero, since for optimal ride comfort the acceleration on the elevator car should be as low as possible. The feedback value for this feedback control is a measurement value for acceleration detected by at least one sensor. The correcting variable of the control function, and the compensating force compensating the disturbance, together form the correcting variable of the controlling means. Within the freely selectable detection accuracy of the disturbance variables and feedback values, activation of the compensating mass takes place very rapidly, preferably in real time; no time delay in the compensation of vibrations occurs which is perceptible by the passenger, and elimination of the vibrations is total.

In support of this process, low-frequency vibrations of from 1 to 100 Hz, preferably of from 2 to 20 Hz, are systematically isolated by the controlling means. By means of systematically low-frequency correcting variables, the compensating mass is driven with correspondingly low frequency, and nuisance vibrations systematically eliminated.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
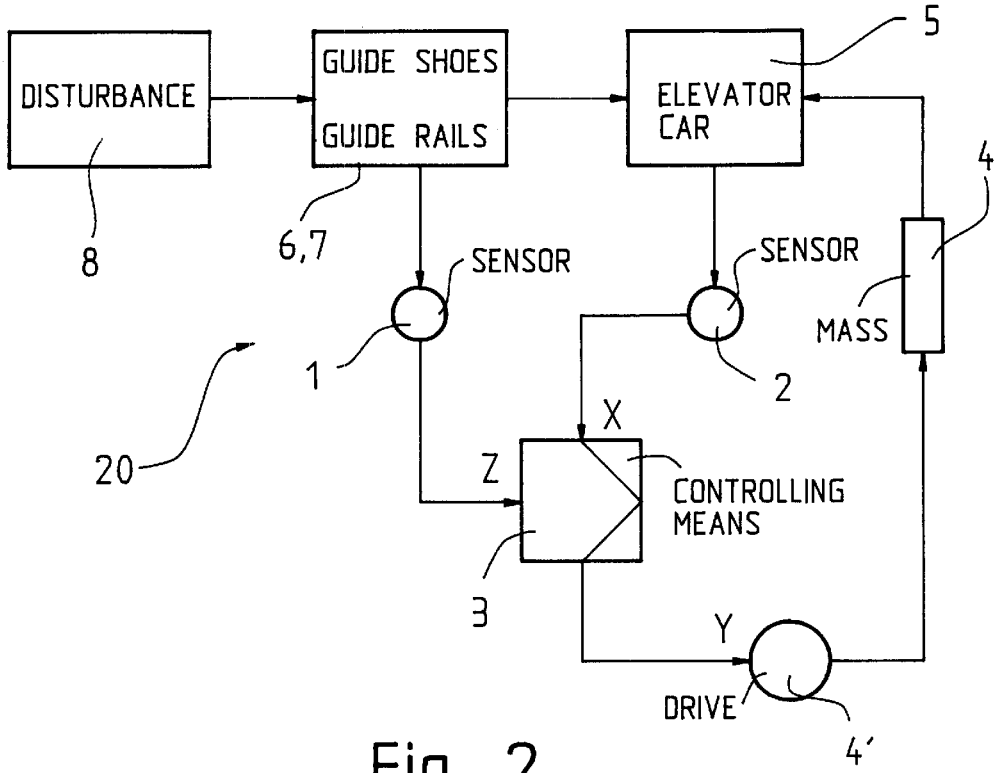
FIG. 1 is a functional block diagram of a first embodiment of a vibration compensating method according to the present invention with an acceleration sensor on a guide shoe.

A method for compensating vibrations in elevator cars according to the present invention is illustrated in exemplary embodiments by schematic functional block diagrams in FIGS. 1 to 4. A system for compensating vibrations in elevator cars according to the present invention is illustrated in exemplary embodiments in FIGS. 6 to 8. As shown in these figures, an elevator car 5 is guided along guide rails 7 by means of guide shoes 6. The elevator car 5 is connected to the guide shoes 6 by means of, for example, springing/damping elements 11 and a car frame 12. The guide shoes 6 roll on the guide rails 7 by means of, for example, guide rollers 6'. In the embodiments shown in FIGS. 6 and 8, the springing/damping elements 11 are fastened to the bottom or floor of the elevator car 5; in the embodiment according to FIG. 7, the springing/damping elements 11 are fastened to the top or roof of the elevator car 5.

With this guidance by means of the guide shoes 6, vibrations occur in the elevator car 5, especially at high guidance speeds. Such vibrations are caused by sources of disturbance 8 (FIGS. 1–4). Such sources of disturbance 8 are, for example, uneven joints or bends in the guide rails 7, by which shocks, centrifugal forces, and inertia forces are generated in the elevator car 5. Disturbances from the sources 8 are transferred, for example, via the guide rail 7 onto the guide shoes 6, and from there into the elevator car 5. Other sources of disturbance 8 originate from pressure variations in the airstream of the moving elevator car 5, and are transmitted into the elevator car 5.

Sources of disturbance 8 are detected by means of at least one first sensor 1 and/or I' as disturbance variables Z. In the exemplary embodiments according to FIGS. 6 to 8, such a first sensor 1 is attached as an acceleration sensor to one of the guide shoes 6. In a further advantageous embodiment according to FIGS. 6 and 8, another such a first sensor 1' is attached as a pressure sensor to the elevator car 5 at, for example, the side of the car. Nuisance vibrations are thus detected as the disturbance variables Z as near as possible to where they occur, i.e. at the source of disturbance 8.

Acceleration values of the elevator car 5 are detected as feedback values X by at least one second sensor 2. In the advantageous embodiments according to FIGS. 6 to 8, such a second sensor 2 is fastened as an acceleration sensor on the elevator car 5, for example on the floor or on the roof of the car. The effects of nuisance vibrations are thus detected as feedback values X as near as possible to where they are experienced as annoying, i.e. on the elevator car 5, preferably near to the springing/damping elements 11 which transmit the nuisance vibrations to the car. The pattern over time of the feedback values X, and of the disturbance variables Z, is detected as a time function at preferably regular time intervals. Within this detection accuracy, the time of occurrence of a disturbing force, and its development over time, are detected both at the source of disturbance 8 and on the elevator car 5. With knowledge of the present invention, the expert can undertake many diverse variations in the detection and arrangement of the at least one second sensor 2. For example, in the embodiment according to FIG. 7, two of the acceleration sensors 2 are attached to the elevator car 5. A first one of the acceleration sensors 2 is mounted on a top or roof of the elevator car 5 close to the springing/damping elements 11, and a second one of the acceleration sensors 2 is mounted on a bottom or floor of the car at a distance from the springing/damping elements. This permits spatially differentiated detection in the elevator car 5 of the propagation and compensation of nuisance vibrations of springing/damping elements 11 by means of the two acceleration sensors 2.

Figure 2:
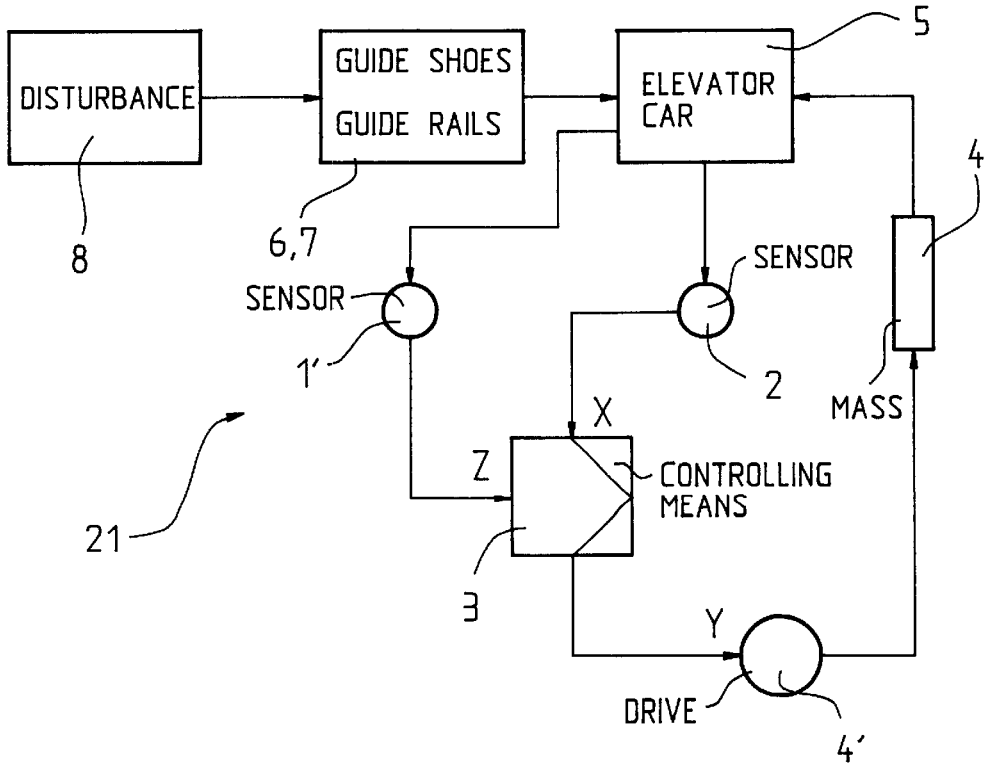
FIG. 2 is a functional block diagram of a second embodiment of the method according to the present invention with a pressure sensor on the elevator car.
Figure 3:
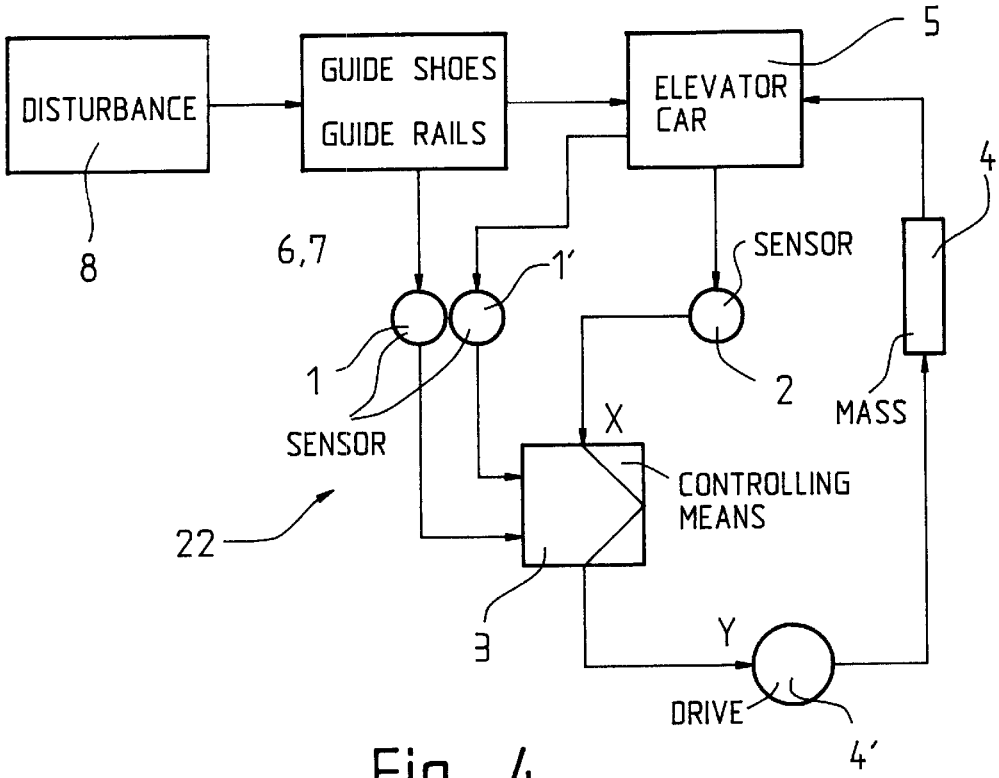
FIG. 3 is a functional block diagram of a third embodiment of the method according to the present invention with an acceleration sensor on a guide shoe and a pressure sensor on the elevator car.
Figure 4:
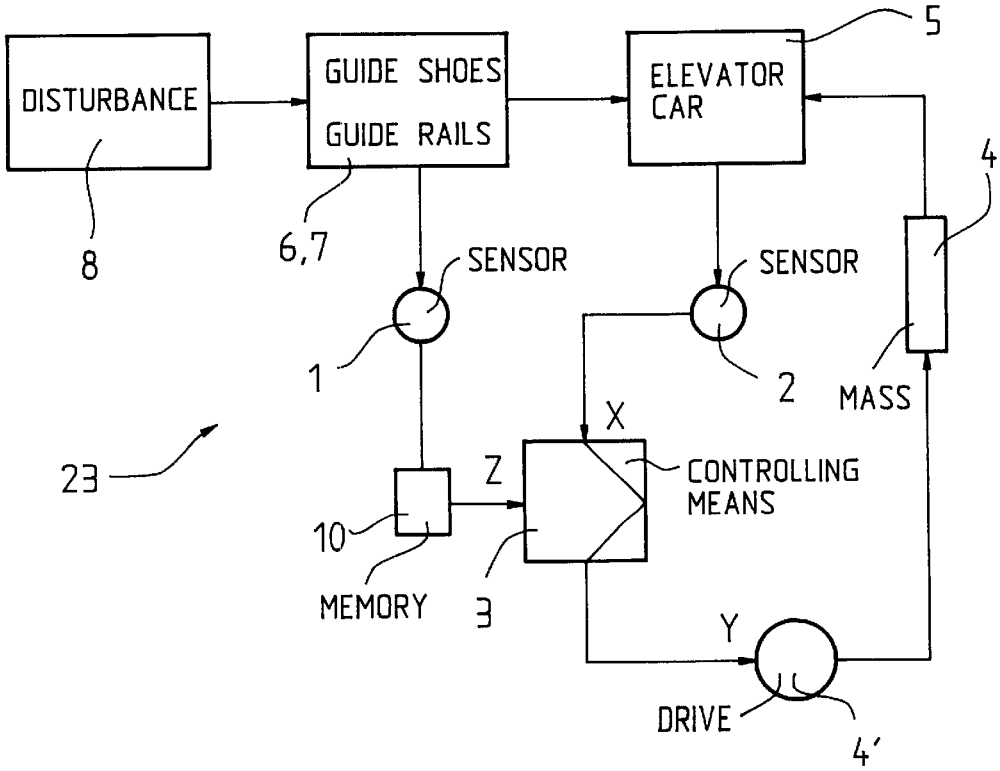
FIG. 4 is a functional block diagram of a fourth embodiment of the method according to the present invention with a memory to store a path profile.

In FIG. 1 there is shown a functional block diagram 20 of a first embodiment of a vibration compensating method according to the present invention with the acceleration sensor 1 on the guide shoe 6. In FIG. 2 there is shown a functional block diagram 21 of a second embodiment of the method according to the present invention with the pressure sensor 1' on the elevator car 5. In FIG. 3 there is shown a functional block diagram 22 of a third embodiment of the method according to the present invention with the acceleration sensor on the guide shoe and the pressure sensor on the elevator car. In FIG. 4 there is shown a functional block diagram 23 of a fourth embodiment of the method according to the present invention with a memory 10 to store a path profile added to the method 20 shown in FIG. 1.

Figure 6:
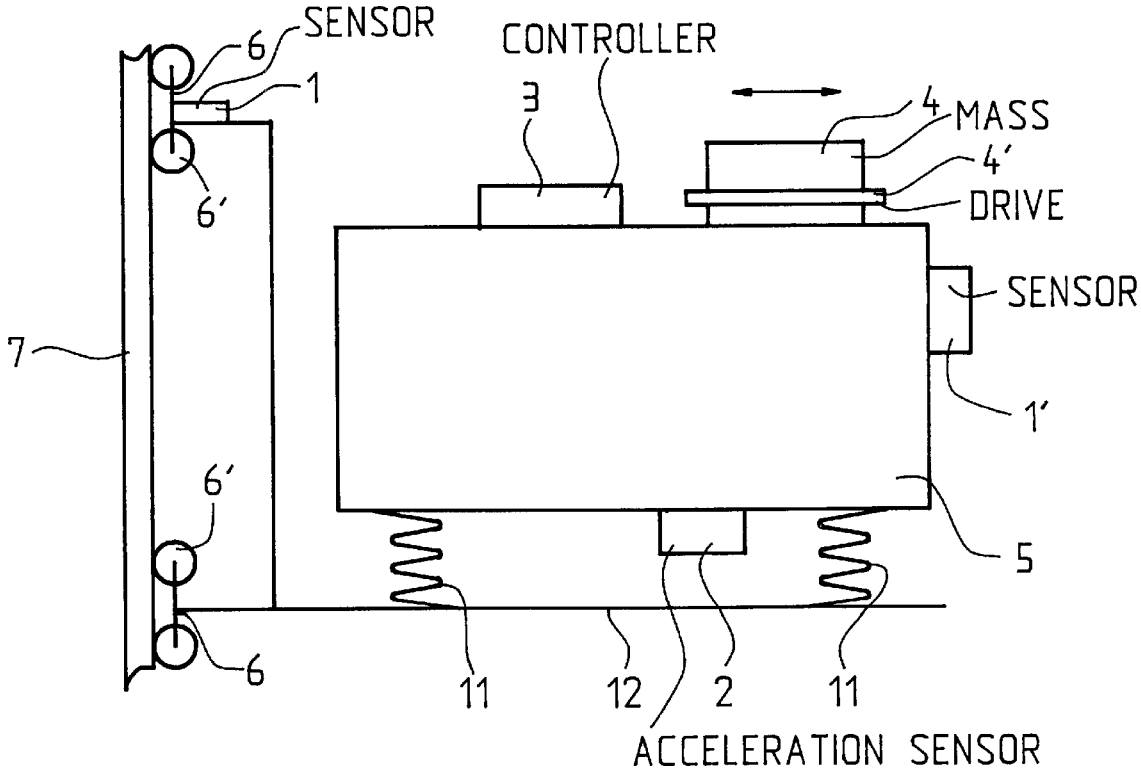
FIG. 6 is a schematic view of a first embodiment of a vibration compensating system according to the present invention operating on a top of an elevator car.

FIG. 6 is a schematic view of a first embodiment of a vibration compensating system 24 according to the present invention operating on a top of the elevator car 5.

Figure 7:
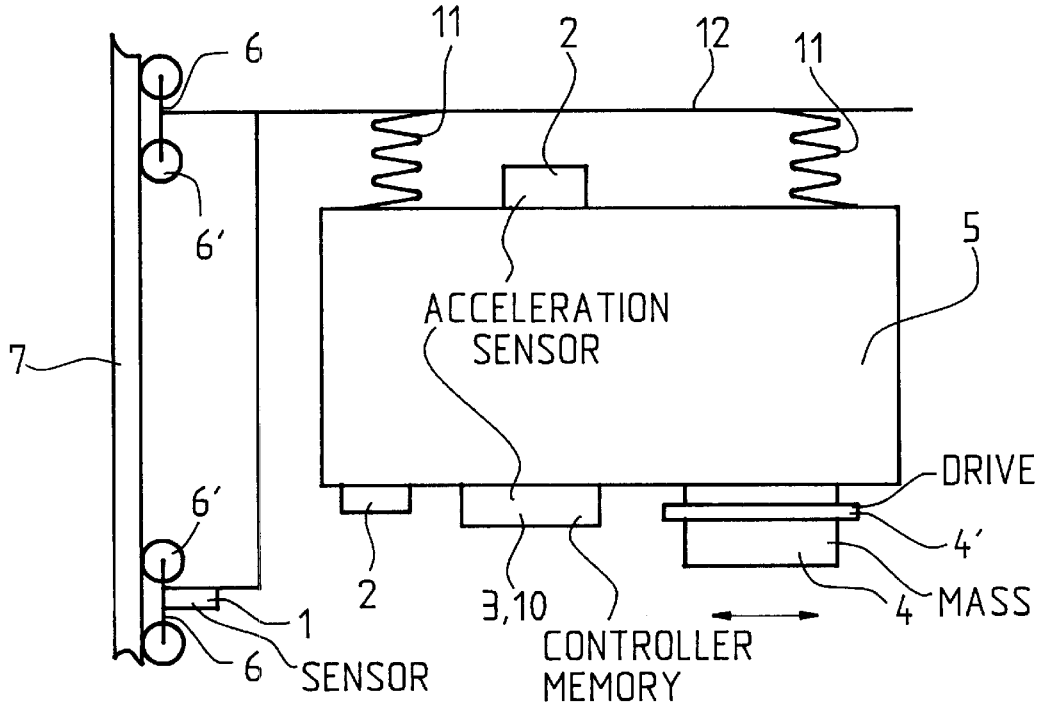
FIG. 7 is a schematic view of a second embodiment of a system according to the present invention operating on a bottom of an elevator car.
Figure 8:
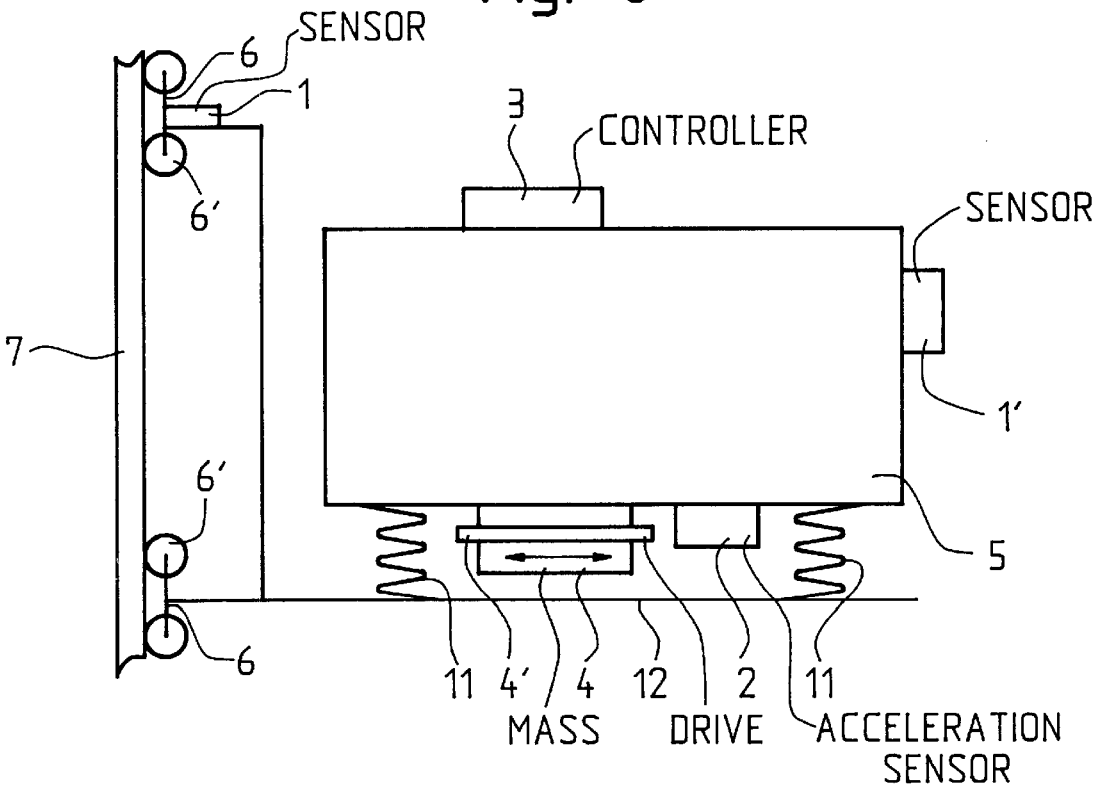
FIG. 8 is a schematic view of a third embodiment of a system according to the present invention operating on a bottom of an elevator car.

FIG. 7 is a schematic view of a second embodiment of a system 25 with the memory 10 according to the present invention operating on a bottom of the elevator car 5. FIG. 8 is a schematic view of a third embodiment of a system 26 according to the present invention operating on a bottom of the elevator car 5.

Figure 5:
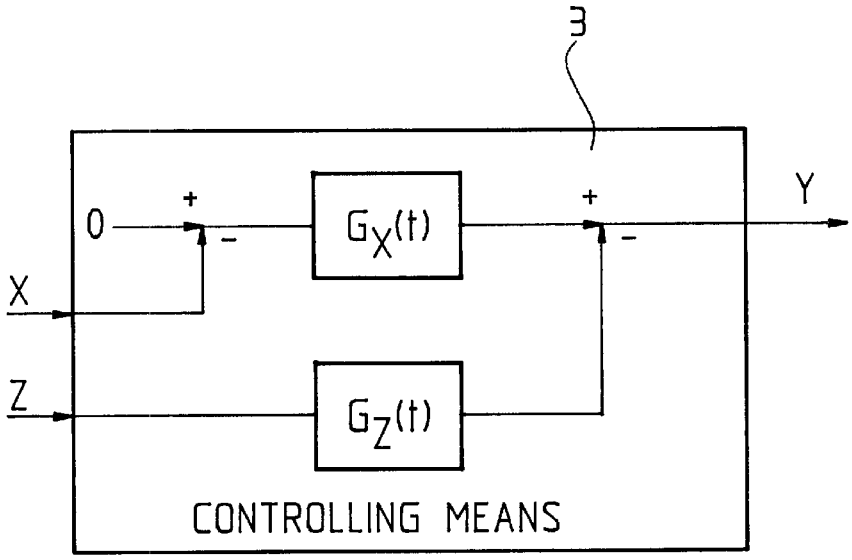
FIG. 5 is a schematic block diagram of the transfer function of the controlling means shown in FIGS. 1–4.

The detection accuracy of the sensors 1, 1' and 2 matches common industry standards: for example, the sensors can detect 200, preferably 20, measurements per second. All known types of sensor having mechanical, optical, and/or electrical construction can be used as the sensors 1, 1' and 2. The embodiments shown in the figures are not imperative: with knowledge of the present invention the expert can implement other placements of the sensors 1, 1' and 2 in any passenger transportation systems. For example, the pressure sensor 1' can be mounted on the floor, or on the roof, of the elevator car 5. It is also possible to use for the sensors 1, 1' and 2 sensors that measure at slower or faster rates. The feedback values X, and the disturbance variables Z, are applied to the input of a controlling means 3. Such a controlling means 3 is shown in an exemplary block diagram in FIG. 5. The controlling means 3 operates with a transfer function. The transfer function contains mapping rules which allow every input variable of the controlling means 3 to be assigned unambiguously to an output variable. The transfer function thus creates a relationship between the pattern over time of the feedback values X and the disturbance variables Z, the input variables at the input to the controlling means 3, and the pattern over time of correcting variables Y that are the output variables at the output of the controlling means. Advantageously the transfer function comprises a time-dependent controlling function $G_x(t)$ and a time-dependent disturbance transfer function $G_z(t)$. Present on the input of the controlling function $G_x(t)$ are the time-variable feedback values X and a specified acceleration reference value 0 for the acceleration of the elevator car with the value zero. Present on the input of the disturbance transfer function $G_z(t)$ are the time-variable disturbance variables Z. The outputs of the controlling function $G_x(t)$ and the disturbance transfer function $G_z(t)$ are subtracted, and thereby form the time-variable output correcting variable Y.

The transfer function can, in principle, be determined in two ways: firstly in that as far as possible all mechanical parameters of the passenger transportation system, which are essentially known, are detected as accurately as possible and set in relation to each other, and secondly in that at least the most important of the mechanical parameters of the passenger transportation system are estimated with sufficient accuracy by means of a modeling method. The modeling method makes use of the measured disturbance variables Z and the measured feedback values X. The mechanical parameters of the passenger transportation system are the unladen weight of the elevator car 5, the momentary position and the weight of at least one compensating mass 4, the stiffness of the springing/damping elements 11, the momentary load being transported, the momentary distribution of the load in the elevator car 5, etc. Certain mechanical parameters such as the unladen weight of the elevator car 5, the weight of the compensating mass 4, and the stiffness of the springing/damping elements 11, can be determined once before the passenger transportation system is put into operation. Other mechanical parameters such as the position of the compensating mass 4, the load being transported, and the distribution of the load in the elevator car 5, are determined with their latest values.

For purely practical reasons, the second method of determination is generally used. The outlay for determining the transfer function by using an adaptable modeling method is usually less. For example, the design engineer and the installation technician naturally know characteristic springing/damping curves which, for a given weight of the elevator car 5, result from a given stiffness of the springing/damping elements 11. Often, 15 however, the weight of the elevator car 5 is not known exactly. This is especially the case during the installation of the passenger transportation system when the elevator car 5 is, for example, often not yet fully fitted out, for example, not cladded inside, and therefore only known with an insufficient accuracy of, for example, 10%. To perform the modeling procedure, at least one of the mechanical parameters must be known with sufficient accuracy and/or have its latest value determined at preferably regular time intervals and its latest value therefore be known with sufficient accuracy. Sufficient accuracy means that the accuracy of the parameter determination is sufficient to perform the modeling procedure successfully. The modeling procedure is successful if a relationship can be constructed between the input variables and output variables of the controlling means 3 such as to systematically compensate the effect of the incoming feedback values X and disturbance variables Z by outgoing correcting variables Y. In the modeling procedure, the mechanical parameter is the basis of the transfer function. Dependent on the input variables and output variables of the controlling means 3, a model of the transfer path is created which simulates the actual behavior. As a function of the incoming feedback values X and disturbance variables Z, the model of the transfer path then delivers the outgoing correcting variables Y. The relationship between the input and output variables of the controlling means 3 is adaptively optimized, i.e. the transfer function which creates this relationship is so adjusted in test runs that the effect of the incoming disturbance variables Z is systematically compensated by outgoing correcting variables Y. When systematically compensating disturbance forces, the disturbance force which has occurred is opposed by a compensating force of equal amount. Known modeling methods that adaptively optimize such input and output variables are the least-squares method, linear regression, etc. With knowledge of the present invention, the expert has many diverse possibilities for realizing such a controlling means 3.

In the controlling means 3, feedback values X are used via the controlling function $G_x(t)$ for feedback control, and the disturbance variables Z are used via the disturbance transfer function $G_z(t)$ for feedforward control. The transfer function allows systematic activation of at least one compensating mass 4 taking into account the known, and/or latest known, mechanical parameters of the passenger transportation system. Systematic activation of the compensating mass 4 is understood as a driving of the compensating weight 4 fastened to the elevator car 5, with the objective of opposing the disturbing force which has arisen with a compensating force of equal amount, and neutralizing the disturbing force.

The controlling means 3 outputs the correcting variables Y to at least one drive 4' of at least one such compensating mass 4 that is to be moved. The drive 4' is, for example, a servodrive which positions in controlled manner the compensating mass 4 which is guided by a known means of guidance. It is advantageous for the compensating mass 4 to be up to 5%, preferably 2%, of the permitted total weight of the elevator car 5. It is advantageous for the compensating mass 4 to be moved linearly or rotationally over a distance of ±10 cm, preferably ±5 cm. The drive 4' is actuated by the controlling means 3 via the correcting variables Y. The compensating mass 4 can be moved periodically or aperiodically back and forth with frequencies of, for example, from 1 to 30 Hz. By this means, the disturbing force developing over time on the elevator car 5 is opposed by a compensating force of equal amount developing over time. It is advantageous for the feedback controller, whose final control element is the drive 4' of the compensating mass 4, to be driven with an acceleration reference value of zero. In the exemplary embodiment according to FIG. 6, the drive 4' and the compensating mass 4 are arranged on the roof of the elevator car 5. In the two exemplary embodiments according to FIGS. 7 and 8, the drive 4' and the compensating mass 4 are fastened under the floor of the elevator car 5. The manner and means of driving, the dimensioning of the compensating mass 4 which is to be moved, and the arrangement of drive 4' and compensating mass 4 relative to the elevator car 5, can be freely ordered with wide scope by the expert with knowledge of the present invention. In the exemplary embodiment according to FIG. 8, the drive 4' and the compensating mass 4 are arranged close to the springing/damping elements 11 so as to compensate as early as possible via the springing/damping elements the disturbing forces transferring to the elevator car 5, i.e. before further propagation of annoying vibrations in the interior of the elevator car to the passengers.

In the embodiment 23 according to FIG. 4, the at least one first sensor 1 detects a path profile of the elevator car 5 along the guide rail 7. This path profile is characteristic of the system comprising elevator car, guide shoes, and guide rail. This path profile is stored in a memory 10 (see also FIG. 7). The memory 10 is of usual commercially available construction, being, for example, an electronic, magnetic, and/or magneto-optical data store. It is advantageous for the stored path profile to be determined once in a calibrating procedure before putting the passenger transportation system into operation. Assuming that the path profile is time-invariant, and with knowledge of the momentary position of the elevator car 5 on the transportation path, permanent mounting of an acceleration sensor 1 on a guide shoe 6 is then unnecessary. Positional detection is usual on elevator cars, and takes place, for example, with a positional resolution of 0.1 mm. Disturbing variables Z in the form of a stored path profile are thus present on the input of the controlling means 3, and are interpreted together with the feedback values X in the controlling means according to the transfer function. During inspections of the elevator the path profile can be checked and, if necessary, updated. The path profile is also a documentation of the condition of the system comprising the elevator car 5, the guide shoes 6, and the guide rails 7.

The controlling means 3 can, through a multiple input, detect disturbance variables Z from several of the acceleration sensors 1 on several guide shoes, and/or from more than one pressure sensor 1' on the elevator car 5. The controlling means 3 can also detect feedback values X from more than one of the acceleration sensors 2 on the elevator car 5. Finally, the controlling means 3 can apply the correcting variables Y on multiple outputs to more than one of the drives 4'. Such a MIMO (multiple input multiple output) controlling means is, for example, designed as a non-linear controller, a neural network, a fuzzy controller, a neuro-fuzzy controller, etc. With knowledge of the present invention, the expert has many and diverse possibilities for the design of the controlling means.

In an advantageous embodiment, low-frequency vibrations, so-called nuisance vibrations, with frequencies of from 10 Hz to 100 Hz, preferably from 2 Hz to 20 Hz, are isolated in the controlling means 3, for example by means of a high-pass filter with a cutoff frequency of 1 Hz to 3 Hz. Such low-frequency vibrations are insufficiently eliminated by normal springing/damping elements 11. Nuisance vibrations are, however, experienced as particularly unpleasant by passengers. By systematic control, the compensating mass 4 is driven with the frequencies of the nuisance vibrations, and the nuisance vibrations are systematically eliminated.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of compensating vibrations in an elevator car having a movable compensating mass mounted on the elevator car comprising the steps of:

(a) detecting first vibrations at a source of disturbance in an elevator system;

(b) detecting second vibrations at a point on an elevator car of the elevator system;

(c) generating correcting variables in response to the detected first and second vibrations; and (d) moving a compensating mass on the elevator car in response to the correcting variables to compensate for the vibrations detected at the point on the elevator car.

2. The method according to claim 1 including providing a controlling means and performing the step (c) by applying the detected first vibrations as disturbance variables to one input of the controlling means, applying the detected second vibrations as feedback values to another input of the controlling means and generating the correcting variables from an output of the controlling means.

3. The method according to claim 2 including a step of storing the detected first vibrations in a memory as a path profile and applying the path profile as the disturbance variables to one input of the controlling means.

4. The method according to claim 1 wherein the step (a) is performed by proving an acceleration sensor at guide shoes associated with the elevator car.

5. The method according to claim 1 wherein the step (b) is performed by proving a pressure sensor on an exterior of the elevator car.

6. The method according to claim 1 wherein the step (b) is performed by proving an acceleration sensor on an exterior of the elevator car.

7. The method according to claim 1 wherein the step (c) is performed by generating the correcting variables in a predetermined frequency range and the step (d) is performed by moving the compensating mass at the frequency of the correcting variables.

8. The method according to claim 7 wherein the predetermined frequency range is approximately 1 Hz to 100 Hz.

9. The method according to claim 7 wherein the predetermined frequency range is approximately 2 Hz to 20 Hz.

10. A system for compensating vibrations in an elevator car comprising:

at least one sensor for generating a disturbance variables signal in response to detecting vibrations at a source of disturbance causing vibrations at a point on an associated elevator car;

at least another sensor for generating a feedback values signal in response to detecting the vibrations at the point on the elevator car;

a controlling means connected to said sensors and responsive to said signals for generating a correcting variables signal;

at least one compensating mass on the elevator car; and a drive connected to said compensating mass and said controlling means and being responsive to said correcting variables signal for moving said compensating mass to compensate for the detected vibrations at the point on the elevator car.

11. The system according to claim 10 wherein said one sensor is an acceleration sensor at guide shoes associated with the elevator car.

12. The system according to claim 10 wherein said one sensor is a pressure sensor on an exterior of the elevator car.

13. The system according to claim 10 wherein said another sensor is an acceleration sensor on an exterior of the elevator car.

14. The system according to claim 10 wherein said controlling means isolates vibrations with frequencies in a predetermined range and generates said correcting variables signal to move said compensating mass with frequencies in the predetermined range to eliminate the vibrations at the point on the elevator car.

15. The system according to claim 10 wherein said one sensor is one of an acceleration sensor on a guide shoe and a pressure sensor on an exterior of the elevator car, and said another sensor is an acceleration sensor on the exterior of the elevator car.

16. The system according to claim 10 including a memory connected between said one sensor and said controlling means for storing said disturbance variables signal along a path of travel of the elevator car as a path profile and applying the stored path profile as said disturbance variables signal to said controlling means.

* * * * *